US011952852B1

(12) United States Patent
Al-Mousa et al.

(10) Patent No.: US 11,952,852 B1
(45) Date of Patent: Apr. 9, 2024

(54) COMPACTING WIRELINE FISHING TOOL AND METHODS OF USE

(71) Applicant: SAUDI ARABIAN OIL COMPANY, Dhahran (SA)

(72) Inventors: Ahmed A. Al-Mousa, Dhahran (SA); Mohammed M. Alibrahim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/156,495

(22) Filed: Jan. 19, 2023

(51) Int. Cl.
*E21B 31/12* (2006.01)
*E21B 23/04* (2006.01)

(52) U.S. Cl.
CPC ..... *E21B 31/125* (2013.01); *E21B 23/0413* (2020.05)

(58) Field of Classification Search
CPC ..... E21B 31/125; E21B 23/0413
See application file for complete search history.

(56) References Cited

U.S. PATENT DOCUMENTS 2,236,761 A * 4/1941 Nichols ..... E21B 31/12 294/86.15
3,152,829 A * 10/1964 Steele, Sr. ..... E21B 31/18 294/86.23
5,106,140 A 4/1992 Knotts
7,096,952 B2 * 8/2006 Harmon ..... E21B 31/20 166/99
8,397,815 B2 3/2013 MacDougall et al.
2004/0031604 A1 * 2/2004 Huggins ..... E21B 31/125 166/98

OTHER PUBLICATIONS

SLB Energy Glossary entry for "fishing tool", accessed Feb. 10, 2024 via https://glossary.slb.com/.*

* cited by examiner

*Primary Examiner* — Blake Michener
(74) *Attorney, Agent, or Firm* — Vorys, Sater, Seymour and Pease, LLP

(57) ABSTRACT

A wireline fishing tool includes a body having opposing upper and lower ends and defining an inner flowpath extending between the upper and lower ends, a spear arranged within the inner flowpath and including a spear body having opposing uphole and downhole ends and an inner channel extending between the uphole and downhole ends. One or more hooks are pivotably attached to the spear body at the downhole end, wherein the spear is movable between a retracted state, where the one or more hooks are arranged within the inner flowpath, and an extended state, where the spear body extends out of the inner flowpath at the lower end and the one or more hooks exiting the inner flowpath, and the one or more hooks pivot radially outward and away from the spear body upon exiting the inner flowpath.

15 Claims, 5 Drawing Sheets

COMPACTING WIRELINE FISHING TOOL AND METHODS OF USE

FIELD OF THE DISCLOSURE

The present disclosure relates generally to wireline tool fishing operations and, more particularly, to a wireline compacting fishing tool for the retrieval of lost wireline and wireline tooling from downhole.

BACKGROUND OF THE DISCLOSURE

Many oil and gas well construction services require the use of wireline and specialized wireline tooling which may perform plugging, perforation, cleaning and logging operations within a wellbore. However, during wireline operations there is a risk of damage to the wireline or the wireline tooling, which can sometimes result in the wireline being cut or severed within the wellbore, thus dropping a large section (length) of the wireline into the wellbore and leaving corresponding tooling downhole. The stuck tooling and long lengths of loose wireline within the wellbore can disrupt hydrocarbon extraction operations. While there are conventional fishing techniques for the retrieval of lost wireline tools from within the wellbore, navigating large lengths of loose wireline downhole can be difficult and costly, which may jeopardize the operations and result in wellbore abandonment or side-track drilling.

In conventional fishing operations, a wireline fishing spear may be utilized to retrieve the lost tooling. Conventional fishing spears, however, lack any compaction capabilities for the compression of loose wireline into a more manageable state. As such, conventional fishing spears may weakly hook onto the wireline, which increases the chances of losing the wireline downhole during the fishing operations. Some conventional wireline fishing spears may further result in severing the wireline during deployment, which complicates retrieval of the wireline tooling with the further loss of loose wireline.

Accordingly, in order to reduce non-productive time and the need to abandon the well or drill a side-tracked wellbore, an improved wireline fishing tool is desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wireline fishing tool includes a body having opposing upper and lower ends and defining an inner flowpath extending between the upper and lower ends, a spear arranged within the inner flowpath and including a spear body having opposing uphole and downhole ends and an inner channel extending between the uphole and downhole ends, and one or more hooks pivotably attached to the spear body at the downhole end. The spear is movable between a retracted state, where the one or more hooks are arranged within the inner flowpath, and an extended state, where the spear body is extended out of the inner flowpath at the lower end and the one or more hooks exit the inner flowpath, and the one or more hooks pivot radially outward and away from the spear body upon exiting the inner flowpath.

In a further embodiment, a method includes conveying a wireline fishing tool into a wellbore on a conveyance. The wireline fishing tool includes a body having opposing upper and lower ends and defining an inner flowpath extending between the upper and lower ends and in fluid communication with the conveyance, a spear arranged within the inner flowpath and including a spear body having opposing uphole and downhole ends and an inner channel extending between the uphole and downhole ends, and one or more hooks pivotably attached to the spear body at the downhole end. The method further includes advancing the wireline fishing tool in the wellbore until locating a downhole tool and loose wireline coupled to the downhole tool, actuating the spear and thereby moving the spear from a retracted state, where the one or more hooks are arranged within the inner flowpath, and an extended state, where the spear body extends out of the inner flowpath at the lower end and the one or more hooks exit the inner flowpath, pivoting the one or more hooks radially outward and away from the spear body upon exiting the inner flowpath, engaging the loose wireline with the one or more hooks, and pulling the conveyance and the wireline fishing tool uphole and simultaneously pulling uphole on the loose wireline.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
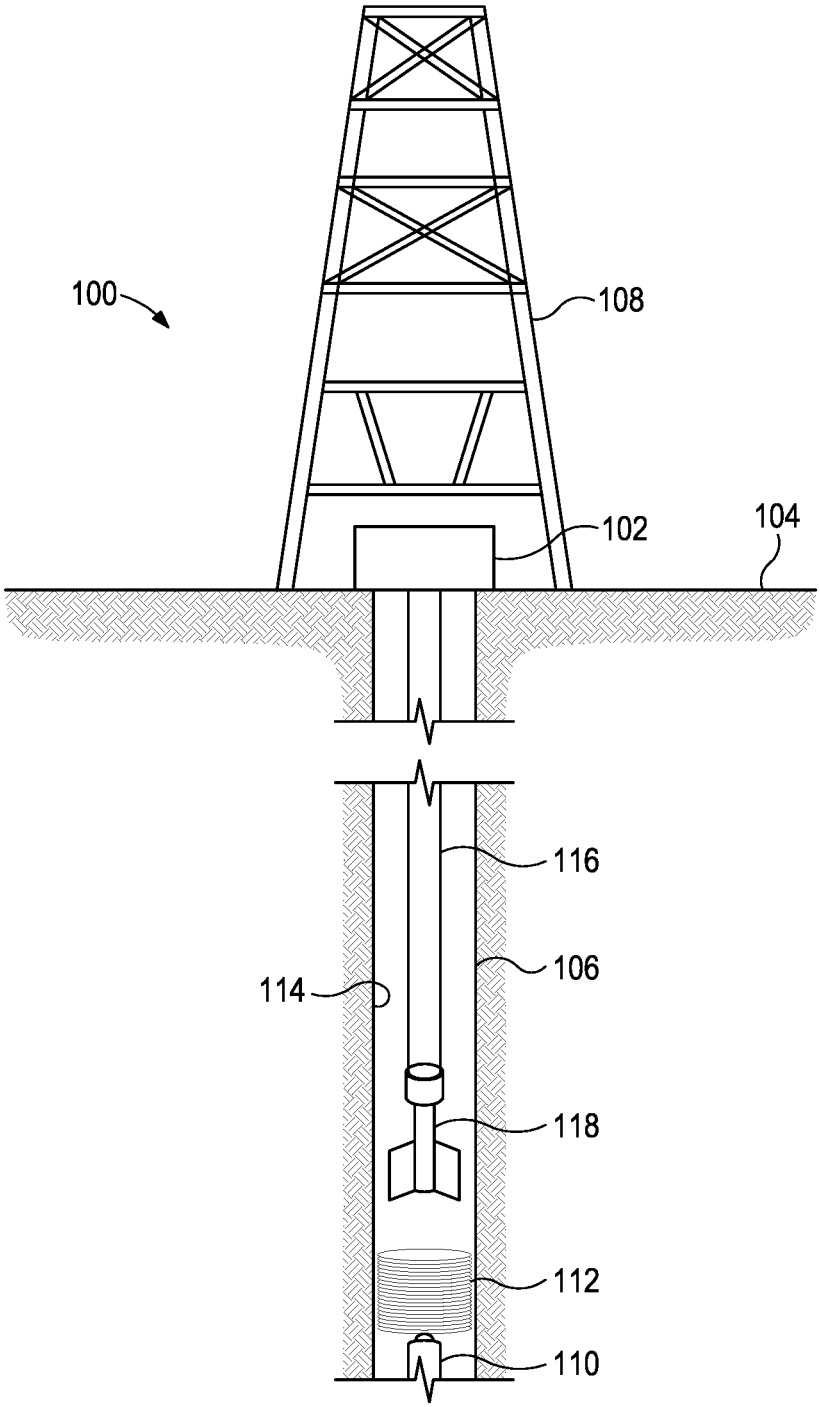
FIG. 1 is a schematic view of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wireline tool fishing operations and, more particularly, to a wireline compacting fishing tool for the retrieval of lost wireline tooling from downhole. Embodiments described herein discuss the use of a single tool for the compaction of loose wireline and subsequent fishing of the wireline tooling. The tools described herein may reduce the chance of losing sheared wireline, increase the chances of successful wireline fishing operations, and reduce costs through a reduction in both tripping downhole and non-productive time.

FIG. 1 is a schematic view of an example well system 100 that may incorporate the principles of the present disclosure. As illustrated, the well system 100 (hereafter "the system 100") includes a wellhead 102 installed at a surface location 104, such as the Earth's surface, and a wellbore 106 that extends from the wellhead 102. The wellbore 106 may be cased, open hole, contain tubing, and/or may generally be characterized as a hole in the ground having a variety of shapes and/or geometries as are known to those of skill in the art. While the system 100 is depicted in FIG. 1 as a land-based system, the principles described herein are equally applicable to subsea operations that employ floating or sea-based platforms and rigs, without departing from the scope of the disclosure.

The system 100 may be configured to undertake a variety of downhole operations using a variety of downhole tools and systems. In at least one embodiment, the system 100 may be suitable for conducting downhole wireline operations. Accordingly, while not shown, the system 100 may include conventional surface equipment configured to facilitate downhole wireline operations used in conjunction with the derrick 108, or additional surface tooling not shown herein.

In the illustrated embodiment, a wireline tool 110 is shown arranged within the wellbore 106. The wireline tool 110 was previously conveyed into the wellbore 106 on a wireline 112, and at some point during the previous wireline operation, the wireline 112 was cut or otherwise severed. As a result, the wireline tool 110 is effectively "stuck" within the wellbore 106, and the wireline 112 has fallen within the wellbore 106 under the force of gravity and is loosely coiled atop the wireline tool 110 and against an interior surface 114 of the wellbore 106. At this point, a wellbore fishing operation is required to retrieve the wireline tool 110; however, the loose wireline 112 may provide an obstacle to accessing the wireline tool. According to embodiments of the present disclosure, the system 100 may further include a wireline fishing tool 118 conveyable into the wellbore 106 and actuatable to grasp onto and retrieve the loose wireline 112 in a safe and efficient manner. Once secured to the loose wireline 112, the wireline fishing tool 118 may be retrieved to the surface 104, thereby simultaneously pulling the wireline 112 and (potentially) the interconnected wireline tool 110 to the surface 104.

In one or more embodiments, the wireline fishing tool 118 (hereinafter, "the tool 118") may be conveyed into the wellbore 106 on a conveyance 116, which may be configured to be rigid enough to transmit an axial load to the tool 118 from the surface location 104. The transmitted axial load will be imparted to (assumed by) the tool 118 to axially compress or "compact" the loose wireline 112 coiled within the wellbore, while simultaneously gathering the loose wireline 112 into a more manageable state. In some embodiments, for example, the conveyance 116 may comprise drill pipe or production tubing, but could alternatively comprise coiled tubing, without departing from the scope of the disclosure. In at least one embodiment, further tooling, such as logging or measurement instruments, may be included as part of a bottom-hole assembly installed on the conveyance 116, without departing from the scope of this disclosure.

Figure 2:
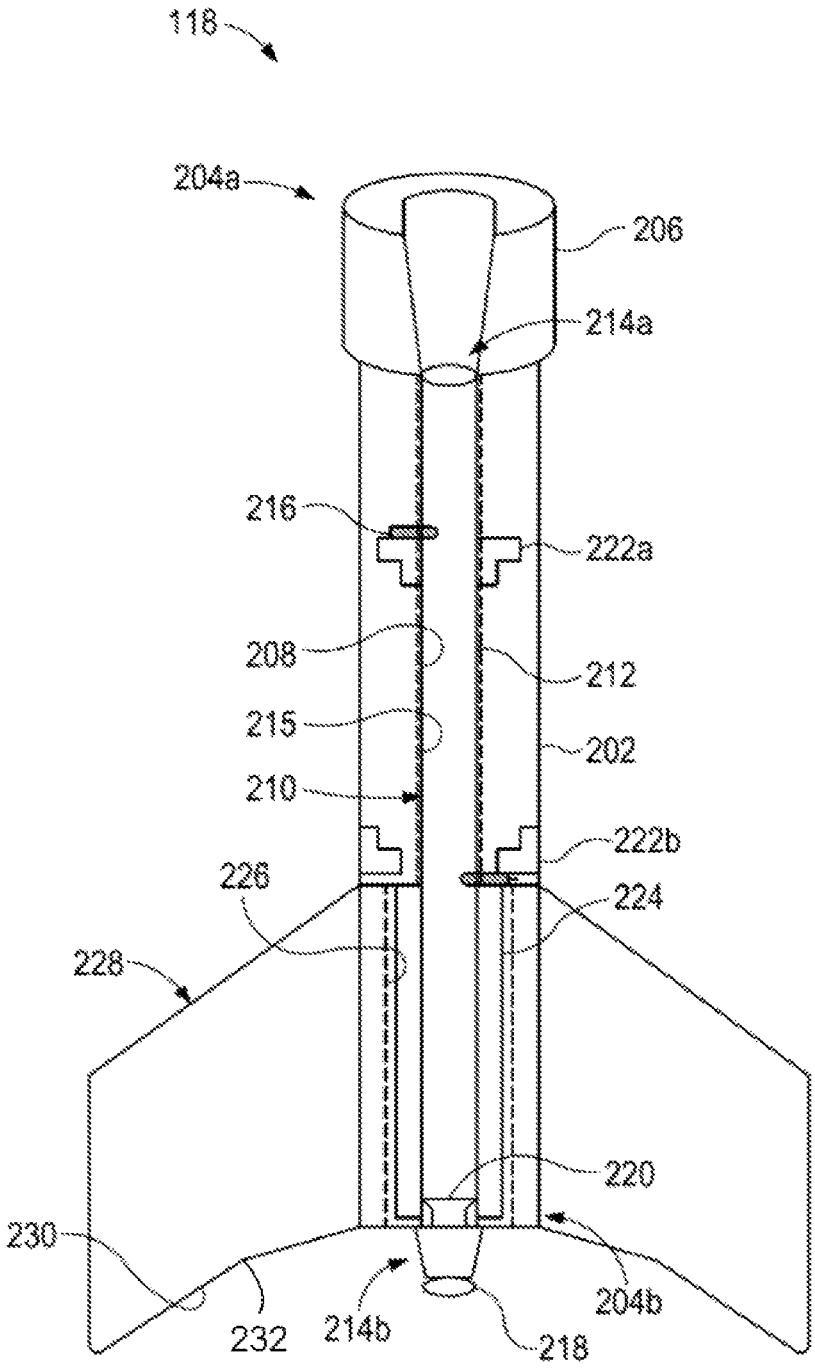
FIG. 2 is a schematic of the compacting wireline fishing tool of FIG. 1, according to one or more embodiments.

FIG. 2 is an enlarged, partial cross-sectional side view of the wireline fishing tool 118, according to one or more embodiments. As illustrated, the tool 118 may provide an elongate body 202 having a first or "upper" end 204*a* and a second or "lower" end 204*b* opposite the first end 204*a*. An upper coupling 206 may be provided or otherwise defined at the upper end 204*a* and may enable the tool 118 to be operatively coupled to the conveyance 116 (FIG. 1). The upper coupling 206 may comprise, for example, a threaded attachment, but could alternatively comprise other types of coupling engagements suitable for operatively coupling the body 202 to the conveyance 116.

In some embodiments, the body 202 may comprise a hollow tube or pipe defining an inner flowpath 208 extending between the upper and lower ends 204*a,b*. The inner flowpath 208 (shown in dashed lines) may be configured to place the tool 118 in fluid communication with the conveyance 116 (FIG. 1), such that fluids conveyed downhole via the conveyance 116 may be transmitted into the flowpath 208. Moreover, the inner flowpath 208 may be sized or otherwise configured to receive a spear 210, which forms part of the tool 118. As illustrated, the spear 210 may provide or otherwise define an elongate spear body 212 sized to be received within the inner flowpath 208. The spear body 212 has a first or "uphole" end 214*a* and a second or "downhole" end 214*b* opposite the uphole end 214*a*. In some embodiments, the spear 210 may be hollow such that the interior of the spear 210 is in fluid communication with the conveyance 116 (FIG. 1) when arranged within the inner flowpath 208. More particularly, the spear body 212 defines or otherwise provides an inner channel 215 extending between the uphole and downhole ends 214*a,b* and in fluid communication with the conveyance 116 when the spear body 212 is arranged within the inner flowpath.

In some embodiments, the spear body 212 may be operatively coupled to the body 202 of the tool 118 using one or more shearable members 216. The shearable members 216 may comprise any type of shearable device or mechanism capable of shearing or otherwise failing upon assuming a predetermined loading (e.g., axial loading). Examples of the shearable members 216 include, but are not limited to, a shear pin and a shear screw. Once the shearable members 216 fail or are otherwise sheared, the spear 210 may be able to transition from a first or "retracted" state, as shown in FIG. 2, to a second or "extended" state, as shown in FIG. 3C and described in more detail below.

A spearhead 218 may be provided at the downhole end 214*b* of the spear 210. In some embodiments, as illustrated, the spearhead 218 may protrude from the inner flow path 208 at the lower end 204*b* of the tool 118 prior to actuation of the tool 118 (e.g., when the spear 210 is in the retracted state). In other embodiments, however, the spearhead 218 may be retracted fully within the inner flowpath 208 prior to actuation. In some embodiments, the spearhead 218 may be conical in shape or otherwise tapered in the downhole direction. The conical or tapered shape of the spearhead 218 may prove advantageous in helping the spear 210 more easily navigate and penetrate the loosely coiled wireline 112 (FIG. 1) during actuation of the tool 118 and when the spear 210 is transitioned to the extended state.

In some embodiments, a projectile seat 220 may be provided or otherwise defined within the inner channel 215 of the spear body 212 at or near the downhole end 214*b*. The projectile seat 220 may be configured to receive a projectile (not shown) conveyed to the tool 118 via the conveyance 116 (FIG. 1). Until the projectile locates and sealingly engages the projectile seat 220, fluids conveyed through the tool 118 may exit the tool 118 through the inner channel 215 and the spearhead 218 or otherwise through the downhole end 214*b* of the spear 210. Upon reaching the projectile seat 220, the projectile will locate and sealingly engage the projectile seat 220, thereby allowing fluid pressure to increase within the tool 118 to actuate the tool 118 and transition the spear 210 from the retracted state to the extended state. More specifically, increasing the fluid pressure within the tool 118, and more particularly within the spear 210, may place an axial load on the shearable members 216. Once the fluid pressure reaches a predetermined limit of the shearable members 216, the shareable members 216 will fail and thereby free the spear 210 from the body 202 of the tool 118. Once freed from the body 202, the fluid pressure within the spear 210 causes the spear 210 to transition from the retracted state to the extended state.

In some embodiments, as illustrated, the spear 210 may include or otherwise provide a first or "upper" landing shoulder 222*a*, and the body 202 of the tool 118 may include or otherwise provide a second or "lower" landing shoulder 222*b*. As the spear 210 transitions from the retracted state to the extended state, the spear 210 progressively advances or extends out of the lower end 204*a* of the tool 118 and the upper landing shoulder 222*a* will eventually locate and engage the lower landing shoulder 222*b*. Engaging the upper and lower landing shoulders 222*a,b* prevents further downhole motion (movement) of the spear 210. As illustrated, the upper landing shoulder 222*a* may be positioned at or near the uphole end 214*a* of the spear 210, and the lower landing shoulder 222*b* may be located anywhere within the tool 118 such that the distance between the landing shoulders 222*a,b* represents the distance the spear 210 may travel outside of the tool 118. In at least one embodiment, the distance between the upper and lower landing shoulders 222*a,b* may be sized such that the spear 210 extends out of the body 202 of the tool 118 to a known predetermined distance. In such embodiments, the predetermined distance may be correlated to the particular application.

In some embodiments, the spear 210 may include or be further equipped with one or more barbs or hooks 224, which may be deployed during actuation of the tool 118 to collect and retain the loose wireline 112 (FIG. 1). The hooks 224 may be pivotably attached to the spear body 212 at or near the downhole end 214*b* of the spear 210. Prior to transitioning the spear 210 out of the body 202 of the tool 118, the hooks 224 may be received within the inner flowpath 208 of the body 202. In at least one embodiment, as illustrated, the inner flowpath 208 may include or otherwise define an enlarged portion 226 sized to receive the hooks 224.

The hooks 224 may be movable or otherwise actuatable between a first or "stowed" configuration, as shown in FIG. 2, and a second or "deployed" configuration, as shown in FIG. 3C. In the stowed configuration, the hooks 224 are arranged within the enlarged portion 226 of the inner flowpath 208 and extend generally flush and along the outer sidewall of the spear body 212. The hooks 224 are able to transition from the stowed configuration to the deployed configuration as the tool 118 is actuated and the spear 210 is transitioned to the extended state. In some embodiments, the hooks 224 may be spring-loaded or otherwise naturally biased radially outward from the spear body 212. Consequently, as the spear 210 is transitioned to the extended state, the hooks eventually migrate out of the inner flowpath 208 and are able to extend (pivot) radially outward to the deployed configuration. In other embodiments, however, the hooks 224 may extend (pivot) radially outward under gravitational force upon being moved out of the enlarged portion 226.

In some embodiments, the tool 118 may further include a compaction component 228 provided at or near the lower end 204*b*. In some embodiments, the compaction component 228 may comprise a singular body forming a recessed cylindrical section that encompasses (extends about) the body 202 of the tool 118. In alternate embodiments, the compaction component 228 may comprise a plurality of fins extending radially outward from the body 202. The compaction component 228 provides or otherwise defines a concave or arcuate lower surface 230. In at least one embodiment, the lower surface 230 of the compaction component 228 may be arranged flush with the lower end 204 of the body 202 of the tool 118. The concave or arcuate nature of the lower surface 230 may prove advantageous in allowing the tool 118 to engage and compact the loose wireline 112 (FIG. 1), which significantly increases the chance of capturing the loose wireline 112 with the spear 210.

In some embodiments, one or more grooves 232 may be provided or otherwise defined on the lower surface 230 of the compaction component 228. The grooves 232 may be configured to allow the loose wireline 112 (FIG. 1) to accumulate without interfering with the spear 210 from reaching its full stroke during actuation to the extended state. As the wireline 112 is engaged and compacted by the lower surface 230, the one or more grooves 232 may catch the compacting wireline 112, which helps maintain compaction of the loose wireline 112 and defines an ideal compaction diameter within the lower surface 230. Catching the wireline 112 in the grooves 232 may also prevent the wireline from accumulating at the center of the tool 118, which could potentially block the stroke pathway of the spear 210.

Figure 3A:
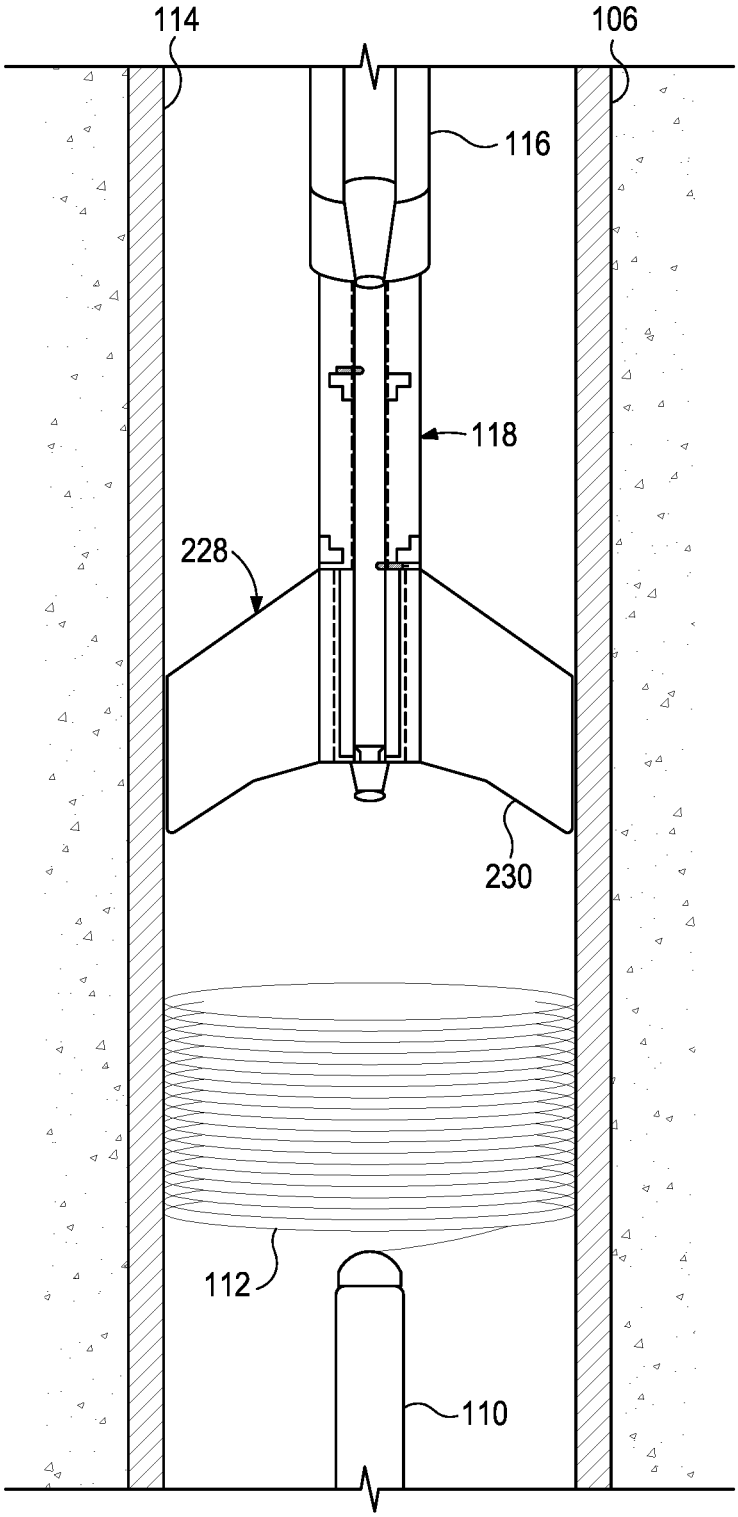
FIG. 3A-3C depict progressive, example operation of the wireline fishing tool of FIG. 2, according to one or more embodiments.
Figure 3B:
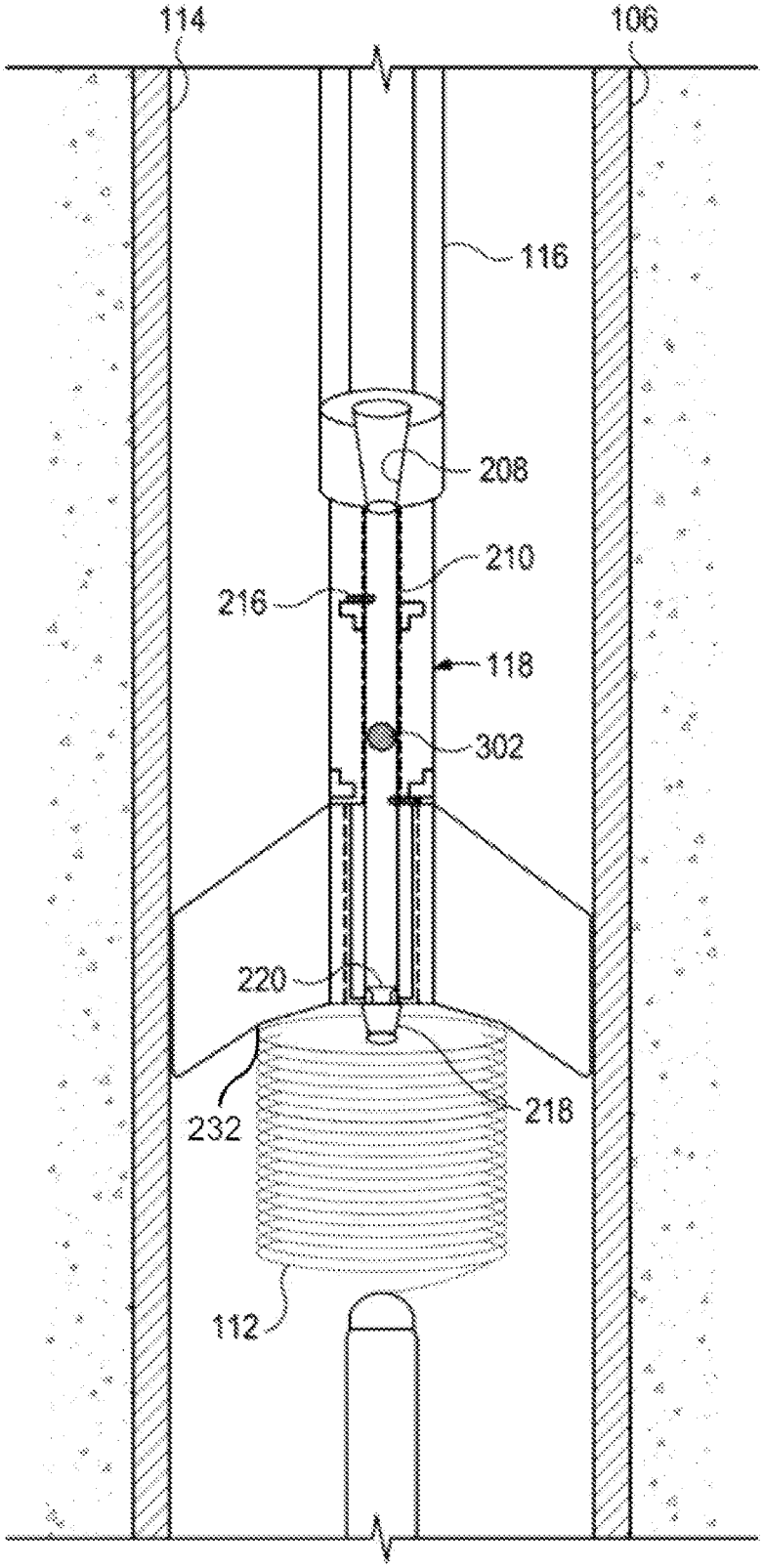
Figure 3C:
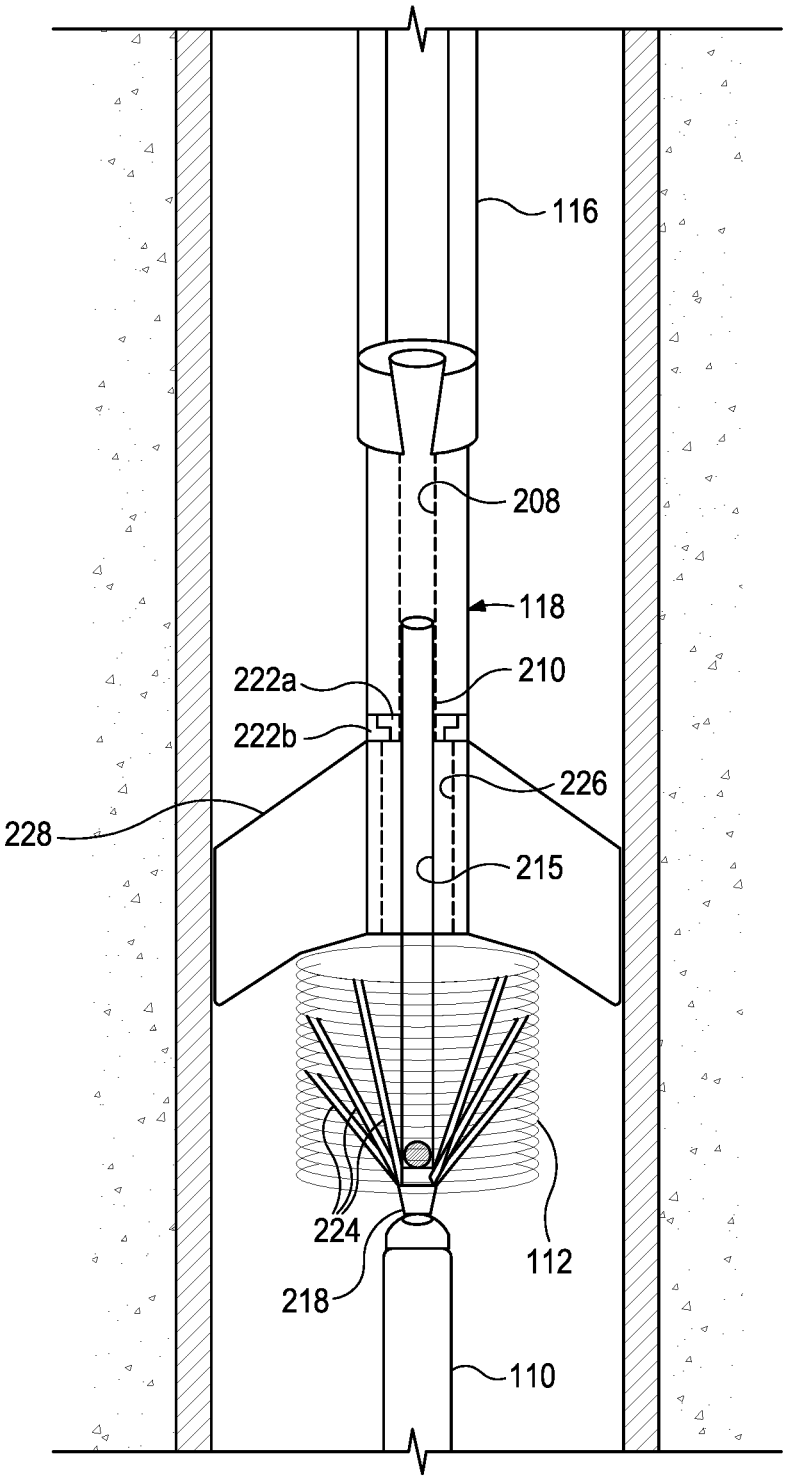

Example operation of the wireline fishing tool 118 will now be provided with references to FIGS. 3A-3C, which depict a series of progressive partial cross-sectional side views of the wireline fishing tool 118 within the wellbore 106, according to one or more embodiments of the present disclosure. In FIG. 3A, the tool 118 has been lowered within the wellbore 106 via the conveyance 116. The compaction component 228 may exhibit a diameter smaller than the inner diameter of the wellbore 106, which allows the tool 118 to be conveyed downhole 106 without binding against the interior surface 114 of the wellbore 106 (or casing that lines the wellbore 106). Moreover, the compaction component 228 may help to guide the tool 118 through the wellbore 106 while maintaining a central location, similar to operation of a centralizer.

FIG. 3A also depicts the loose wireline 112 falling within the wellbore 106 and otherwise resting atop the downhole tool 110 in a generally "un-compacted" state within the wellbore 106. In other words, the loose wireline 112 may be spread about within the wellbore 106 without any general compaction. As the tool 118 continues lowering, the lower surface 230 of the compaction component 228 may first engage the loose wireline 112, which may start the compaction or "gathering" process of the loose wireline 112. The concave shape or curvature of the lower surface 230 of the compaction component 228 may cause the loose wireline 112 to collect and gather into the grooves 232 of the compaction component 228, and otherwise amass the loose wireline 112 into a more manageable bunch.

In FIG. 3B, the loose wireline 112 has been compacted radially inwards and otherwise gathered away from the interior surface 114 of the wellbore 106. As it is compacted, the loose wireline 112 may be received within the one or more grooves 232, such that the loose wireline 112 may not interfere with travel of the spear 210. Thus the compacted diameter of the loose wireline 112 may be determined by the one or more grooves 232. After reaching the desired depth and simultaneously compacting the loose wireline 112, a wellbore projectile 302 may be dropped downhole within the conveyance 116. In one or more embodiments, the wellbore projectile 302 may comprise a spherical ball, as illustrated, but in other embodiments the wellbore projectile 302 may comprise a wellbore dart or any downhole projectile having a shape capable of mating with and sealingly engaging the projectile seat 220. In at least one embodiment, the wellbore projectile 302 may be pumped downhole, but could otherwise descend under gravitational forces.

The wellbore projectile 302 may travel the length of the conveyance 116, enter the inner flowpath 208 of the tool 118, and flow or transition into the inner channel 215 of the spear 210. Once in the inner channel 215, the wellbore projectile 302 may advance further until reaching and sealingly engaging the projectile seat 220. Once the wellbore projectile 302 sealingly engages the projectile seat 220, an increase in pressure from the surface equipment will create a pressure increase within the tool 118. To actuate the tool 110, the pressure within the tool 118 may be increased until reaching an internal pressure corresponding to the shear limit of the one or more shearable members 216. Once the shear limit of the shearable members 216 is reached, the shearable members 216 will fail and thereby release the spear 210, which allows the spear 210 to transition from the retracted state to the extended state. As the spear 210 transitions to the extended state, the spearhead 218 correspondingly extends downhole and penetrates the loose wireline 112.

In FIG. 3C, the spear 210 has been released from the tool 118 and is depicted in the extended state after reaching the full travel prescribed by the opposing landing shoulders 222*a,b*. More specifically, as the spear 210 transitions to the extended state, the opposing landing shoulders 222*a,b* will eventually engage and mate, thus preventing further downhole movement of the spear 210. Moreover, as the spear 210 reaches the bottom of its travel, the spearhead 218 will correspondingly penetrate the compacted or "gathered" wireline 112.

As the spear 210 transitions to the extended state, the hooks 224 will simultaneously extend out of the enlarged portion 226 of the inner flowpath 208, which allows the hooks 224 to transition from the stowed configuration, as shown in FIGS. 3A-3B, to the deployed configuration, as shown in FIG. 3C. In the stowed configuration, the hooks 224 are arranged within the enlarged portion 226 of the inner flowpath 208, and upon escaping the inner flowpath 208, the hooks 224 are no longer constrained and therefore able to transition to the deployed configuration.

As briefly mentioned above, in at least one embodiment, the hooks 224 may be spring-loaded and otherwise naturally biased radially outward to the deployed configuration. In other embodiments, however, the hooks 224 may naturally pivot and fall radially outward via gravitational forces, without departing from the scope of the disclosure. Consequently, once the hooks 224 extend out of the inner flowpath 208, they may naturally pivot or extend radially outward to the deployed configuration from their stowed configuration.

With the hooks 224 in the deployed configuration, the hooks may be able to spread out and engage or "hook" the loose wireline 112, thereby securing the loose wireline 112 and preventing any shearing or damage. The engagement of the hooks 224 with the loose wireline 112 may have the added effect of an increased grip on the lost wireline tool 110 to prevent slippage or loss of the lost wireline tool 110 during extraction.

FIG. 3C depicts the hooks 224 engaged with the compacted loose wireline 112, and securing the compacted loose wireline 112 in multiple locations. It should be noted that any number of hooks 224 may be included in the tool 118 without departing from the scope of this disclosure. In at least one embodiment, the hooks 224 may be curved or arcuate for catching the compacted loose wireline 112, and may further exhibit or include hooked or slanted tips for helping to guide or draw the compacted loose wireline 112 towards the spear 210 and retain it therein. The hooks 224 may be released in any number of radial directions such that the outer diameter of the spear 210 may be fully surrounded by hooks 224 which have been deployed to catch a maximized amount of compacted loose wireline 112. Further, the hooks 224 may be of different lengths and/or shapes.

Once the hooks 224 are in the deployed configuration, the tool 118 may then be drawn or pulled uphole using the conveyance 116. As the conveyance 116 moves up hole, the tool 118 simultaneously pulls on the wireline 112, which may also pull on and thereby recover the lost wireline tool 110. As will be appreciated, the hooks 224 may prove advantageous in that the compacted loose wireline 112 may be secured in multiple points and compacted such that the risk of shearing or further loss is reduced. Similarly, the multiple points of contact with the compacted loose wireline 112 provides redundancy for the retention of the lost wireline tool 110 such that one point of failure will not lose the lost wireline tool 110 again. The entirety of the conveyance 116, the tool 118, and the lost wireline tool 110 may be withdrawn to the surface location 104 (not shown here) and the fishing operation may be completed in a single downhole trip with reduced non-productive time.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wireline fishing tool, comprising:

a body having opposing upper and lower ends and defining an inner flowpath extending between the upper and lower ends;

a spear arranged within the inner flowpath and including a spear body having opposing uphole and downhole ends and an inner channel extending between the uphole and downhole ends; and one or more hooks pivotably attached to the spear body at the downhole end, wherein the spear is movable between a retracted state, in which the one or more hooks are arranged within the inner flowpath, and an extended state, in which the spear body is extended out of the inner flowpath at the lower end and the one or more hooks exit the inner flowpath, and wherein the one or more hooks pivot radially outward and away from the spear body upon exiting the inner flowpath.

2. The wireline fishing tool of claim 1, wherein the inner flowpath defines an enlarged portion, and wherein the one or more hooks are received within the enlarged portion and extend along an outer sidewall of the spear body when the spear is in the retracted state.

3. The wireline fishing tool of claim 1, wherein the one or more hooks are spring-loaded to pivot radially outward and away from the spear body upon exiting the inner flowpath.

4. The wireline fishing tool of claim 1, further comprising a compaction component provided at the lower end of the body and defining a concave lower surface for engaging and compacting loose wireline within a wellbore.

5. The wireline fishing tool of claim 4, further comprising one or more grooves defined on the concave lower surface and sized to receive the loose wireline during compaction.

6. The wireline fishing tool of claim 1, further comprising a spearhead arranged at the downhole end.

7. The wireline fishing tool of claim 1, further comprising:

one or more shearable members operatively coupling the spear body to the body; and a projectile seat provided within the inner channel and configured to receive and sealingly engage a projectile conveyed into the inner channel, wherein a fluid pressure within the body and the spear body is increased upon sealingly engaging the projectile on the projectile seat, and wherein increasing the fluid pressure shears the one or more shearable members to allow the spear to transition from the retracted state to the extended state.

8. The wireline fishing tool of claim 1, further comprising:

an upper landing shoulder provided the spear near the uphole end; and a lower landing shoulder provided by the body and engageable with the upper landing shoulder, wherein the upper landing shoulder advances toward the lower landing shoulder as the spear moves to the extended position, and wherein engaging the upper landing shoulder on the lower landing shoulder stop movement of the spear toward the extended position.

9. The wireline fishing tool of claim 1, further comprising an upper coupling included at the upper end and providing a location for coupling a conveyance to the body and thereby placing the inner flowpath and the inner channel in fluid communication with the conveyance.

10. A method, comprising:

conveying a wireline fishing tool into a wellbore on a conveyance, the wireline fishing tool including:

a body having opposing upper and lower ends and defining an inner flowpath extending between the upper and lower ends and in fluid communication with the conveyance;

a spear arranged within the inner flowpath and including a spear body having opposing uphole and downhole ends and an inner channel extending between the uphole and downhole ends; and one or more hooks pivotably attached to the spear body at the downhole end, advancing the wireline fishing tool in the wellbore until locating a downhole tool and loose wireline coupled to the downhole tool;

actuating the spear and thereby moving the spear from a retracted state, where the one or more hooks are arranged within the inner flowpath, and an extended state, where the spear body extends out of the inner flowpath at the lower end and the one or more hooks exit the inner flowpath;

pivoting the one or more hooks radially outward and away from the spear body upon exiting the inner flowpath;

engaging the loose wireline with the one or more hooks; and pulling the conveyance and the wireline fishing tool uphole and simultaneously pulling uphole on the loose wireline.

11. The method of claim 10, wherein pulling the conveyance uphole further comprises simultaneously pulling the downhole tool uphole as connected to the loose wireline.

12. The method of claim 10, wherein the wireline fishing tool further includes a compaction component provided at the lower end of the body and defining a concave lower surface, and wherein advancing the wireline fishing tool further comprises engaging and compacting the loose wireline with the compaction component.

13. The method of claim 12, further comprising capturing the loose wireline within one or more grooves defined on the concave lower surface and thereby preventing the loose wireline from obstructing actuation of the spear.

14. The method of claim 10, wherein the wireline fishing tool further includes a spearhead arranged at the downhole end of the spear body, and wherein actuating the spear further comprises penetrating the loose wireline with the spearhead as the spear body extends out of the inner flowpath.

15. The method of claim 10, wherein the wireline fishing tool further includes one or more shearable members operatively coupling the spear body to the body and a projectile seat provided within the inner channel, and wherein actuating the spear further comprises:

conveying a projectile downhole within the conveyance;

receiving the projectile within the inner flowpath and the inner channel, and advancing the projectile to the projectile seat;

increasing a fluid pressure within the body and the spear body once the projectile sealingly engages the projectile seat, and shearing the one or more shearable members as the fluid pressure increases and thereby freeing the spear body from the body to allow the spear to transition from the retracted state to the extended state.

* * * * *